US006469687B1

(12) United States Patent
Janssen

(10) Patent No.: US 6,469,687 B1
(45) Date of Patent: Oct. 22, 2002

(54) DRIVER CIRCUIT AND METHOD FOR ELECTRO-OPTIC DISPLAY DEVICE

(75) Inventor: Peter Janssen, Scarborough, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/221,956

(22) Filed: Dec. 28, 1998

(51) Int. Cl.[7] ..... G09G 3/36

(52) U.S. Cl. ..... 345/94; 345/76; 345/89; 345/204; 345/208; 345/51; 348/790; 348/792; 348/293

(58) Field of Search ..... 345/51, 89, 76, 345/94, 204, 208; 328/790, 792, 793

(56) References Cited

U.S. PATENT DOCUMENTS 3,649,819 A * 3/1972 Waller ..... 345/13
4,437,764 A * 3/1984 Levine et al. ..... 348/242
5,648,793 A * 7/1997 Chen ..... 345/209
5,740,616 A * 4/1998 Seddon et al. ..... 33/554
5,812,104 A * 9/1998 Kapoor et al. ..... 345/76
5,828,357 A 10/1998 Tami et al. ..... 345/89
5,847,701 A * 12/1998 Eglit ..... 345/204

* cited by examiner

*Primary Examiner*—Bipin Shalwala
*Assistant Examiner*—Vincent E. Kovalick

(57) ABSTRACT

In driver circuitry for driving an electro-optic display device having a row and column matrix array of pixels, including means for converting incoming digital display information signals into analog signals, sampling errors due to switch and column resistance and transmission delays are compensated by converting the digital samples for alternate columns (or rows) to analog signals having sampling errors of equal magnitude but opposite sign.

17 Claims, 6 Drawing Sheets

DRIVER CIRCUIT AND METHOD FOR ELECTRO-OPTIC DISPLAY DEVICE

BACKGROUND OF THE INVENTION

This invention relates to an electro-optic display device for displaying continuously updated image information represented by signals arranged in successive frames, and more particularly relates to the driver circuits employed to address the display device with the image information signals.

Display devices of this type employ a row-and-column matrix array of pixels, for modulating light in accordance with the image information signals applied during successive frame periods. In color displays, each frame is typically divided into sub-frames, one for each component color of the color signal. The signal information is applied to the pixel array, usually a row at a time during each frame or sub-frame period, by electronic driver circuits.

These electronic drivers and their interconnection to the array make up a significant portion of the cost of a display device. For this reason, manufacturers are attempting to integrate the driver circuits into the display device itself. Electro-optic displays such as liquid crystal displays (LCDs), are analog by nature. For example, the light transmissivity of a twisted nematic (TN) LC varies with the amount of voltage applied across the LC cell. In order to ease interfacing to the emerging digital environment, the most desirable driver circuits are therefor those which accept digital input signals and convert them into analog signals.

For a high quality picture, a large number of gray shades must be represented by such signals, preferably on a perceptually harmonic scale, such that all brightness steps in the display are virtually indistinguishable by a human observer. For this purpose, 256 gray levels, corresponding to 8 bit digital data, are considered adequate.

A conceptually simple design for such a digital driver circuit is described by A. Erhart, SID 92 Digest, 41.4: "256-Grey-Level Column Drivers: A Review of Two IC Architectures", pp. 793–797. In this design, the incoming digital signal is sampled by a large number of column driver circuits, and the samples are compared to a common ramp-shaped analog signal, generated internally or externally. As long as a switch in the sampling circuit remains closed, the column lines simply track the common analog voltage of the ramp generator. D/A conversion of the samples is achieved when the analog voltage of the ramp generator corresponds to the digital word stored in the column register, causing the switch to open. When the switch opens, the ramp voltage value of that moment is stored by the column line capacitance, until the end of the row address interval (or Row period) when the pixel transistor switch is turned off. From that moment, the column voltage remains stored on the pixel capacitance until it is refreshed again in a next frame period.

At the high sampling rates needed for high quality displays, common problems of this design are voltage loss due to the resistance of the switch and the column line, and the transmission delay of the column line. The result is that the voltage stored in the column line capacitance is not equal to the ramp voltage at the moment of sampling.

Although it is desirable to keep absolute sampling errors smaller than one half of the smallest step, ie., one half of a least significant bit (LSB), it may not be feasible, practical or cost effective to implement the low switch and column line resistances necessary to achieve this goal.

OBJECTS AND SUMMARY OF THE INVENTION

Accordingly, it is an object of the invention to provide a driver circuit and method for driving an electro-optic display device for displaying continuously updated image information signals arranged in successive frames, in which the effects of sampling errors are reduced or eliminated.

It is another object of the invention to provide such a circuit and method, in which the effects of sampling errors from the digital-to-analog conversion of the information signals are reduced or eliminated.

In accordance with the invention, the effects of sampling errors introduced during digital-to-analog conversion of information signals in such a driver circuit are effectively cancelled by generating two sets of analog information signals in which sampling errors are equal in magnitude but opposite in sign, and addressing alternate columns (or rows), or alternate sets of columns (or rows), with these information signals, whereby the effects of the sampling errors in the display are reduced or eliminated.

In accordance with a first aspect of the invention, a driver circuit is provided for driving an electro-optic display device comprised of a row-and-column matrix array of pixels, to display continuously updated image information in the form of signals arranged in successive frames, by modulating light in accordance with the signals during successive frame periods, the circuit comprising a digital-to-analog converter for converting a first set of digital information signals into a first set of analog information signals having sampling errors, and for converting a second set of digital information signals into a second set of analog information signals having sampling errors equal in magnitude but opposite in sign to the sampling errors of the first set, and means for alternately applying the first and second sets of analog information signals to the array, whereby the average effect of t he sampling errors is zero.

In accordance with a preferred embodiment of this aspect of the invention, the driver circuit includes means for applying the first and second sets of analog information signals to alternate columns (or rows) of the array, or to alternate sets of columns (or sets of rows) during each frame period, so that sampling errors in adjacent columns (or rows), or adjacent sets of columns (or sets of rows), are equal in magnitude but opposite in sign for each frame period. The sampling errors are thus averaged over the array during each frame period.

In accordance with another preferred embodiment of this aspect of the invention, the digital-to-analog converter includes:

a first analog ramp signal generator for generating a ramp signal which begins at zero or a low absolute voltage value and ramps up to a maximum absolute voltage value; means for successively comparing the first set of digital information signals to the analog ramp up signal; and means for selecting the analog information signal values which correspond to the digital information signals; and a second analog ramp signal generator for generating a ramp signal which begins at a maximum absolute voltage value and ramps down to zero or a low absolute voltage value; means for successively comparing the second set of digital information signals to the analog ramp down signal; and means for selecting the analog information signal values which correspond to the digital information signals.

The driver circuit may alternately include means for applying the first and second sets of analog information signals to the array during alternate frame periods, so that sampling errors in alternate frames are equal in magnitude but opposite in sign. In this case, the digital-to-analog converter may employ a single analog ramp signal generator having means for alternately generating a first analog ramp up signal and a second analog ramp down signal, and the digital-to-analog conversion can proceed for an entire frame of digital information signals using the first ramp signal, and for the next frame using the second ramp signal. The sampling errors are thus averaged over a time of successive frame periods, instead of being averaged over the array during each frame period. The digital-to-analog converter includes means for successively comparing the digital information signals to the analog ramp signal; and selecting analog information signal values which corresponds to the digital information signals.

In accordance with a second aspect of the invention, a method is provided for driving an electro-optic display device comprised of a row-and-column matrix array of pixels, to display continuously updated image information in the form of signals arranged in successive frames, by modulating light in accordance with the signals applied during successive frame periods, wherein the method comprises the steps of:

(I) converting a first set of digital information signals to a first set of analog information signals having sampling errors;

(ii) converting a second set of digital information signals to a second set of analog information signals equal in magnitude but opposite in sign to the sampling errors of the first set;,and (iii) alternately applying the first and second sets of converted analog signals to the array, whereby their average effect is zero.

In accordance with a preferred embodiment of the method, the first and second sets of converted analog signals are applied to alternate columns (or rows) of the array, or to alternate sets of columns (or sets of rows) during each frame period, so that sampling errors in adjacent columns (or rows), or in adjacent sets of columns (or sets of rows), are equal in magnitude but opposite in sign during each frame period.

In accordance with another preferred embodiment of the method, the first set of digital information signals are converted to analog information signals by: generating an analog ramp signal which begins at zero or a low absolute voltage value and ramps up to a maximum absolute voltage value; successively comparing the digital information signals to the analog ramp up signal; and selecting analog information signal values which correspond to the digital information signals; and the second set of digital information signals are converted to analog information signals by: generating an analog ramp signal which begins at a maximum absolute voltage value and ramps down to zero or a low absolute voltage value; successively comparing the digital information signals to the analog ramp down signal; and selecting analog information signal values which corresponds to the digital information signals.

Alternatively, the first and second sets of converted analog signals are applied to the array during alternate frame periods, so that sampling errors in alternate frames are equal in magnitude but opposite in sign. In this case, digital-to-analog conversion can be carried out by alternately generating a first analog ramp up signal and a second analog ramp down signal, and converting an entire frame of digital information signals using the first ramp up signal, and then converting the next frame using the second ramp down signal. The sampling errors are thus averaged over a time of successive frame periods, instead of being averaged over the array during each frame period. The digital information signals are converted to analog information signals by successively comparing the digital information signals to the analog ramp signal; and selecting analog information signal values which corresponds to the digital information signals.

As is known, most electro-optic display devices, and in particular liquid crystal display devices, are driven with AC voltage, commonly achieved by inverting the polarity of the driving waveform with each new frame of information. As is also known, the polarities of alternate columns (or rows), or sets of columns (or sets of rows) can also be inverted with each new frame. Nevertheless, it should be appreciated that the principles of the invention are applicable regardless of these inversions of the polarities of the driving waveform so long as the sampling errors generated in the two sets of digital information signals are equal in magniture and opposite in sign. This will be achieved regardless of the polarities of the ramp signals, so long as one of the ramp signals (herein ramp signal or waveform A) is a ramp up signal, and the other ramp signal (herein ramp signal or waveform B) is a ramp down signal.

Depending on the architecture of the decoding circuits used, the digital input signals corresponding to waveforms A and B may have to be stored in normal and complementary form, respectively.

DESCRIPTION OF THE PREFERRED EMBODIMENTS

Figure 1:
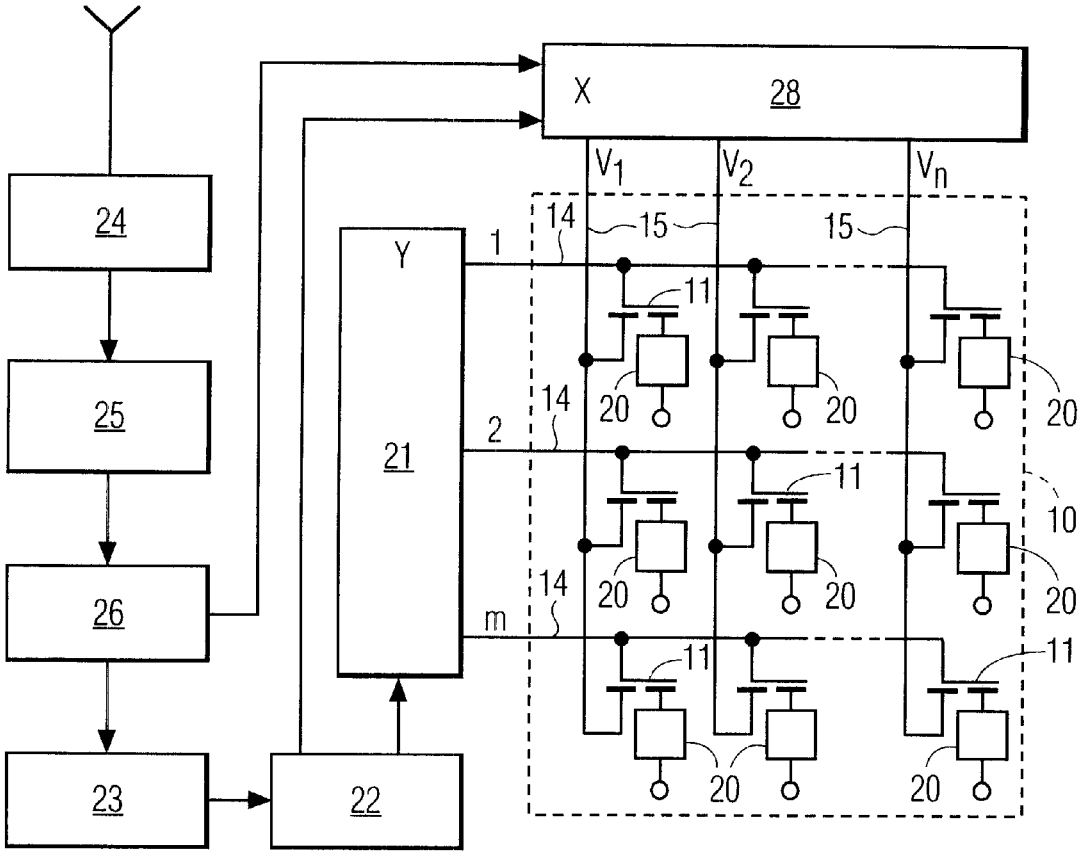
FIG. 1 is a simplified plan view of a typical AMLCD display device of the prior art.

Referring to FIG. 1, there is shown schematically a block diagram of a LCD-TV display system of the prior art including a display device which comprises an AMLCD panel 10. The panel 10 consists of m lines (1 to m) with n horizontal display (picture) elements or pixels 20 (1 to n) in each line. In practice, the total number of display elements (m×n) in the matrix array may be 100,000 or more (up to 1.3 million or more for HDTV). Each display element 20 (representing one pixel of the display) has an associated TFT transistor acting as a switching element. The gates of all the TFTs in each line are connected to a row (Y) electrode 14 and the source electrodes of each TFT in a column are connected to a column (X) electrode 15, there being m row electrodes 14 and n column electrodes 15. The drains of the TFTs 11 are connected to respective electrodes of the display elements in a manner which will be described.

A common counterelectrode for the display elements is carried by a substrate spaced from the substrate carrying the TFTs and the associated electrodes of the display elements with liquid crystal material disposed therebetween. The liquid crystal material modulates light according to voltage applied there across. Addressing of each line of the matrix array of display elements 20 is achieved by applying a gate voltage to the row electrode 14 for that line for an addressing time Ta. This turns on all TFTs in that row of the matrix, allowing video information to be transferred to the display elements via the column electrodes 15. The row electrodes are sequentially addressed in this manner to provide line-at-a-time scanning of the entire matrix array. One completed scan of the matrix array represents one frame of video information, after which the array is readdressed with the next frame of information.

During the time Ta in which the TFTs in one line are turned on to allow addressing, all of the other TFTs in the remaining rows of the array are switched off, thus isolating their associated picture elements from stray voltages which would otherwise introduce display-degrading cross-talk. During this time interval, these isolated picture elements must maintain their picture information by virtue of their natural capacitance and any auxiliary storage capacitance (not shown in this figure).

As can be seen in FIG. 1, the row (Y) electrodes 14 are driven by a digital shift register 21 supplied with regular timing pulses from a clock circuit 22 which is fed with line synchronizing pulses from a synchronization separator 23 derived from the incoming signals via a tuner 24, IF circuits 25 and video amplifier 26.

Video information signals are supplied to the column (X) electrodes 15 simultaneously from shift register circuit 28, comprising one or more shift registers, supplied with video signals from the video amplifier 26 and timing pulses from the clock circuit 22 in sync with line addressing. The shift register circuit provides serial-to-parallel conversion appropriate to the line-at-a-time addressing of the panel 10, samples the corresponding line in the digital video signal and places the appropriate analog voltages on the column (X) electrodes 15, thence to the source side of the TFTs in the column. When the TFTs in the line being addressed are turned on, the voltage at each source is transferred to the drain, and thence to the picture element connected to the drain, whereby the liquid crystal associated with the element is charged with the source voltage representing the video information for that element.

Figure 2:
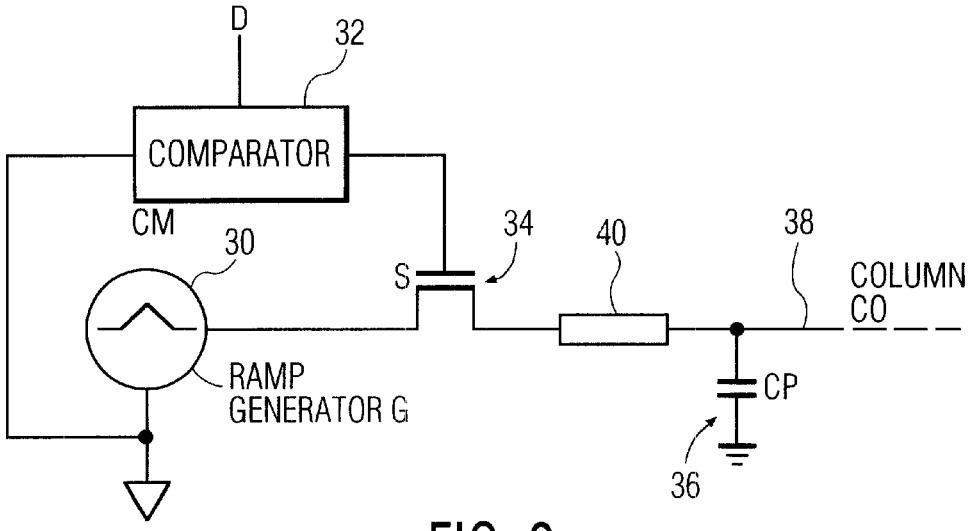
FIG. 2 is a schematic diagram of a track and hold sampling circuit of the prior art.

Referring now to FIG. 2, there is shown a schematic representation of a track and hold sampling circuit of the prior art, in which a ramp generator 30 generates an analog ramp signal which ramps up from zero or a low value to a maximum value, and comparator 32 compares a digital word D representative of gray level information with the digital word representing the ramp signal. When the analog ramp signal reaches a value which matches the value represented by the digital word, switch 34 opens and the analog signal is stored in the capacitance 36 of column 38. However, due to the resistance of the switch and the column, represented by resistance 40, and the transmission delay of the column line, the analog signal voltage stored in the column line capacitance is not equal to the ramp voltage at the moment of sampling.

Figure 3A:
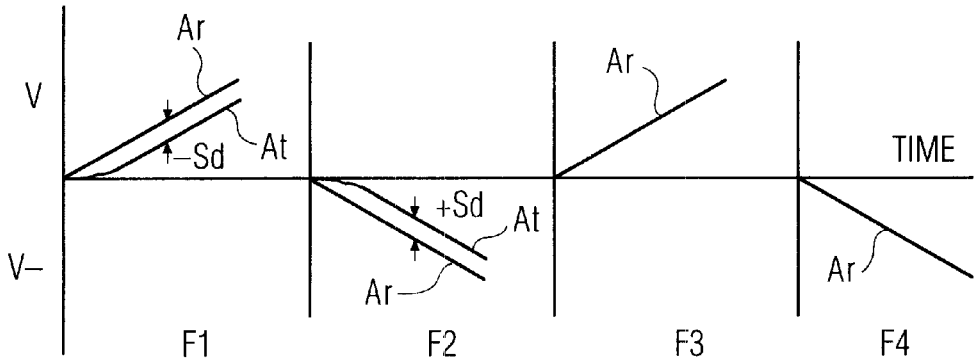
FIG. 3A is a graph of voltage versus time showing the tracking error introduced for the track and hold sampling circuit of the type shown in FIG. 2 employing a ramp up analog ramp signal in a frame inversion driving scheme.

This sampling error is illustrated graphically in FIG. 3A, in which both the analog ramp voltage and the voltage which is stored on the column capacitance are plotted versus time for a frame inversion driving scheme. Line Ar represents the ramp signal generated by ramp signal generator 30 in FIG. 2, while curve At represents the stored voltage. At any particular time, the voltage difference Sd represents the sampling error for the sampled information signal (word) D. Due to frame inversion driving, the slopes of Ar and At, and the sign of Sd, alternate between positive and negative from one frame period to the next. Thus, the slopes of Ar and At are both positive, and the sign of Sd is negative in frame F1, and the slopes of Ar and At are both negative, and the sign of Sd is positive in frame F2. Frames F3 and F4 show the continuation of this inversion for Ar, but not for At.

Figure 7:
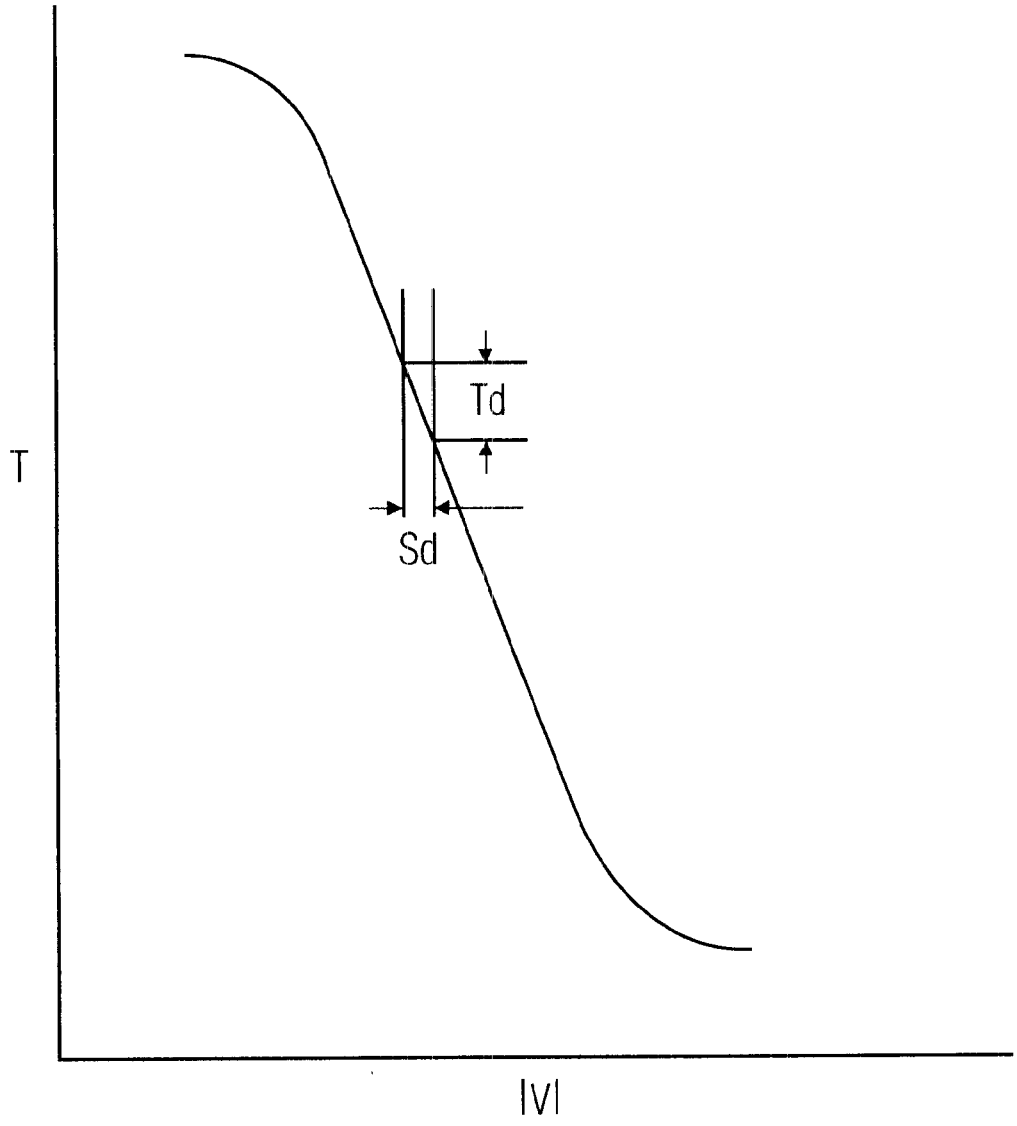
FIG. 7 is a graph of optical transmission of a pixel versus voltage applied to the pixel.

Although the sign of the sampling error Sd changes from frame period to frame period, the effect of the error on the pixel brightness remains the same. This is due to the fact that in both cases, the sampling error Sd reduces the absolute value of the voltage signal applied to the pixel, and although the sign of the voltage signal changes, the optical response of the LC material is insensitive to this change in polarity. In the commonly employed "drive-to-dark" pixel driving scheme, the smaller signal results in a pixel brightness greater than intended. This condition is illustrated graphically in FIG. 7, which is an optical transmission (T) vs absolute voltage value |V| curve for a typical LC material, on which curve the sampling error Sd and resulting transmission increase Td are indicated.

Figure 3B:
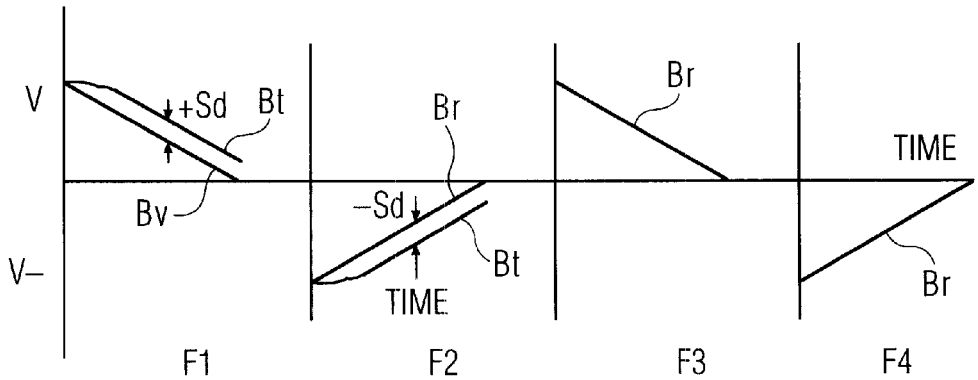
FIG. 3B is a graph similar to that of FIG. 3A employing a ramp down analog ramp signal.

In accordance with the invention, the effect of the sampling error Sd on the display can be offset by generating information signal samples with sampling errors of equal magnitude but opposite sign on every other column or row. These information signal samples can be generated by employing a second ramp generator to generate an opposite-going (ramp down) ramp signal, represented by line Br in FIG. 3B, resulting in a signal stored on the column or row of Bt, and a sampling error at any particular time of Sd. As can be appreciated, the sampling error in the case of the ramp down ramp signal increases the absolute value of the applied voltage, rather than decreasing it, as is the case for the ramp up ramp signal. Thus, despite the change in polarity from frame to frame, the sampling error remains opposite in sign to the sampling error associated with the ramp up ramp signal.

Figure 4:
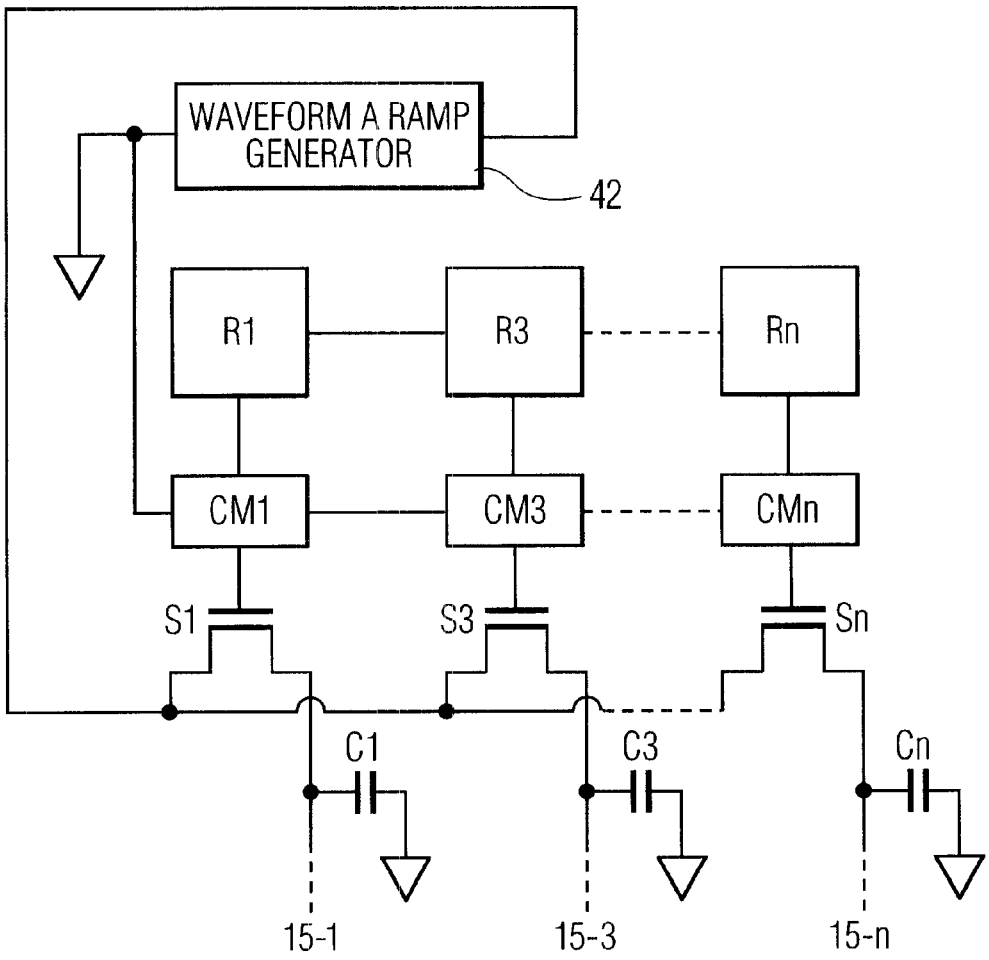
FIGS. 4 and 5 are schematic diagrams showing the A and B waveform drivers, respectively, of the dual ramp driving scheme in accordance with one embodiment of the invention.
Figure 5:
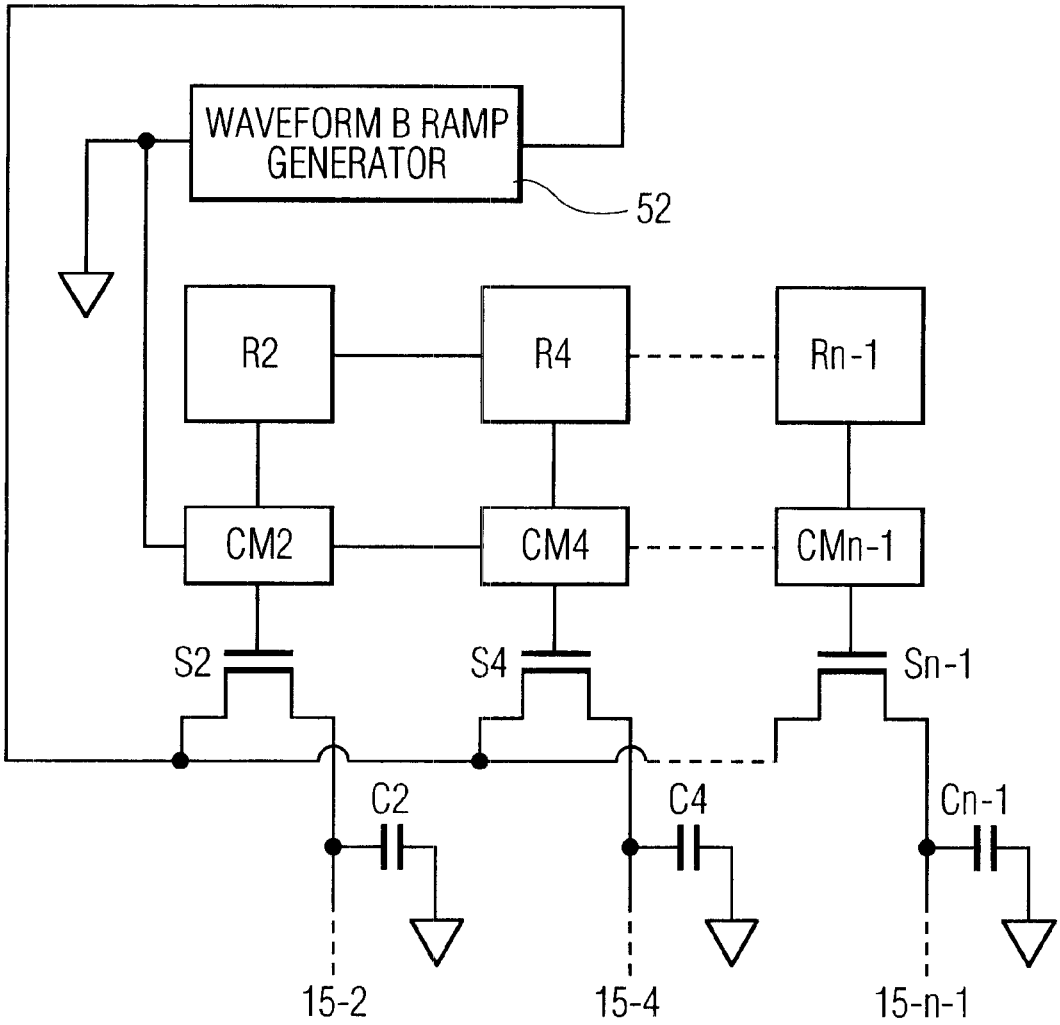

FIGS. 4 and 5 are schematic diagrams illustrating A and B waveform drivers, respectively, in accordance with one embodiment for driving the display system of FIG. 1 with a dual ramp D/A conversion driving scheme of the invention. In FIG. 4, waveform A ramp generator 42 generates a common analog ramp signal for the odd-numbered columns 15-1, 15-3, . . . 15-n as well as a digital word representing the common analog ramp signal. Register 28 contains individual registers R1, R2, R3, . . . Rn containing the digital words representing the information signals for each column. Comparators CM1, CM3, . . . CMn compare the words in the odd-numbered registers R1, R3, . . . Rn to the digital word representing the common analog ramp signal, and as matches occur, switches S1, S3, . . . Sn open, allowing the voltages representative of the digital words to be stored in the column capacitances C1, C3, . . . Cn.

In FIG. 5, waveform B ramp generator 52 generates a common ramp signal for the even-numbered columns 15-2, 15-4, . . . 15n-1. Comparators CM2, CM4, . . . CMn-1 compare the words in the even-numbered registers R2, R4, . . . Rn-1 to the digital word representing the common analog ramp signal, and as matches occur, switches S2, S4, . . . Sn-1 open, allowing the voltages As the voltages stored in the column capacitances are applied across individual pixels, the pixels in adjacent columns of the display will have brightness errors of equal magnitude but opposite sign. Over the entire display, these brightness errors will tend to be averaged by the observer, effectively canceling the errors.

Figure 6:
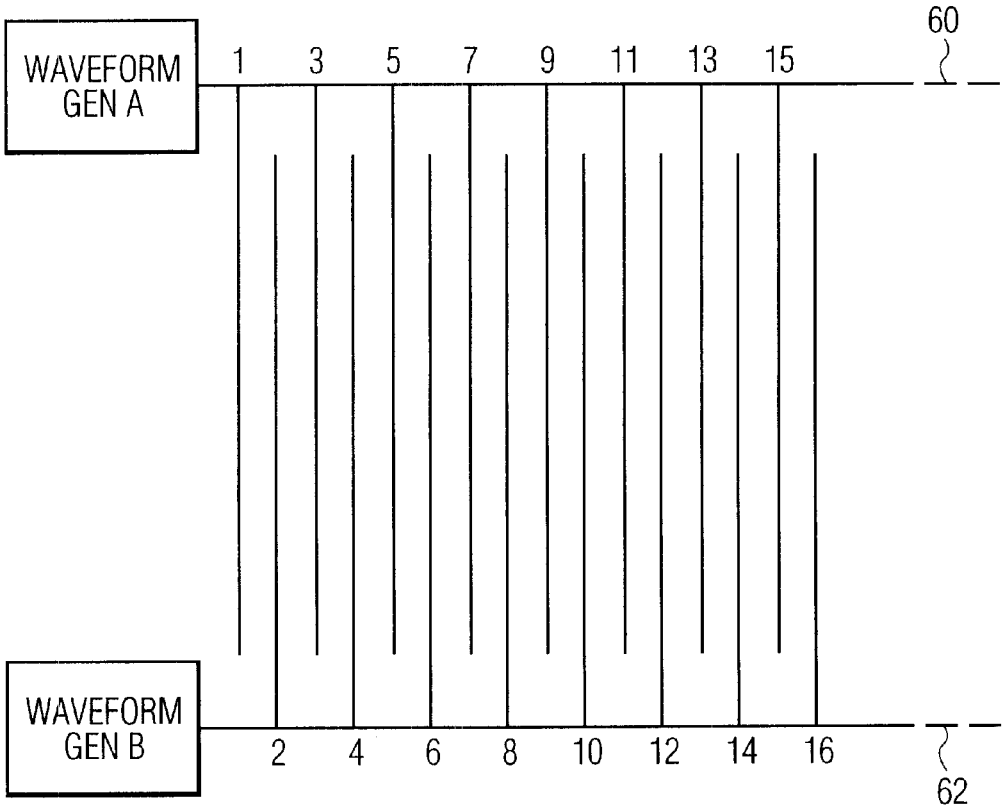
FIG. 6 is a schematic diagram showing one arrangement of integrating the A and B waveform drivers with a column array.

FIG. 6 shows one arrangement for integrating the A and B waveform generators into the array. Waveform A ramp generator is connected to the odd-numbered columns via a bus line 60 along the top of the array, while waveform B ramp generator is connected to the even-numbered columns via a separate bus line 62 along the bottom of the array.

The invention has been described in terms of a limited number of embodiments. Other embodiments, variations of embodiments and art-recognized equivalents will become apparent to those skilled in the art, and are intended to be encompassed within the scope of the invention, as set forth in the appended claims.

What I claim as my invention is:

1. A driver circuit for driving an electro-optic display device comprised of a row-and column matrix array of pixels, to display continuously updated image information in the form of signals arranged in successive frames, by modulating light in accordance with the signals during successive frame periods, the circuit comprising a digital-to-analog converter for converting a first set of digital information signals into a first set of analog information signals having sampling errors, and for converting a second set of digital information signals into a second set of analog information signals having sampling errors equal in magnitude and opposite in sign to the sampling errors of the first set of signals, and means for applying the first and second sets of analog information signals to the array in a manner such that the average effect of the sampling errors is zero.

2. The driver circuit of claim 1 wherein the means for applying the first and second sets of analog information signals apply said signals to alternate columns (or rows) of the array, or to alternate sets of columns (or sets of rows) during each frame period, so that sampling errors in adjacent columns (or rows), or adjacent sets of columns (or sets of rows), are equal in magnitude but opposite in sign.

3. The driver circuit of claim 2 in which the digital-to-analog converter includes:

a first analog ramp signal generator for generating a ramp signal which begins at zero or a low absolute voltage value and ramps up to a maximum absolute voltage value; means for successively comparing the first set of digital information signals to the analog ramp up signal; and means for selecting the analog information signal values which correspond to the digital information signals; and a second analog ramp signal generator for generating a ramp signal which begins at a maximum absolute voltage value and ramps down to zero or a low absolute voltage value; means for comparing the second set of digital information signals to the analog ramp down signal; and means for selecting the analog information signal values which correspond to the digital information signals.

4. The driver circuit as claimed in claim 2 wherein the digital to analog converter comprises:

a first analog ramp signal generator for generating a ramp signal which begins at a low absolute voltage value and ramps up to a maximum absolute positive voltage value, and a second analog ramp signal generator for generating a ramp signal which begins at a maximum absolute negative voltage value and ramps down to a low absolute voltage value.

5. The driver circuit as claimed in claim 4 wherein the sampling error for the ramp down ramp signal increases the absolute value of the applied voltage and the sampling error for the ramp up ramp signal decreases the absolute value of the applied voltage, whereby the sampling errors effectively cancel one another.

6. The driver circuit of claim 1 in which the first and second sets of analog information signals are applied to the array during alternate frame periods, so that sampling errors in alternate frames are equal in magnitude but opposite in sign.

7. The driver circuit of claim 6 in which the digital-to-analog converter includes an analog ramp signal generator having means for generating a first analog ramp signal which begins at zero or a low absolute voltage value and ramps up to a maximum absolute voltage value; means for successively comparing the first set of digital information signals to the analog ramp up signal; and means for selecting the analog information signal values which correspond to the digital information signals; and means for generating a second analog ramp signal which begins at a maximum absolute voltage value and ramps down to zero or a low absolute voltage value; means for successively comparing the second set of digital information signals to the analog ramp down signal; and means for selecting the analog information signal values which correspond to the digital information signals.

8. The driver circuit as claimed in claim 1 wherein the sampling errors are the result of a variable, data dependent, load on the digital-to-analog converter.

9. The driver circuit as claimed in claim 1 wherein the first and second sets of analog information signals are applied to alternate columns/rows of the array with the same polarity, but the sampling errors in the two sets of analog information signals have opposite signs.

10. A method of driving an electro-optic display device comprised of a row-and-column matrix array of pixels, to display continuously updated image information in the form of signals arranged in successive frames, to modulate light in accordance with the signals applied during successive frame periods,. wherein the method comprises the steps of:

(i) converting a first set of digital information signals to a first set of analog information signals having sampling errors;

(ii) converting a second set of digital information signals to a second set of analog information signals having sampling errors equal in magnitude and opposite in sign to the sampling errors of the first set of signals; and (iii) alternately applying the first and second sets of converted analog signal to the array such that their average effect is zero.

11. The method of claim 10 in which the first and second sets of converted analog signals are applied to alternate columns (or rows) of the array, or to alternate sets of columns (or sets of rows) during each frame period, so that sampling errors in adjacent columns (or rows), or in adjacent sets of columns (or sets of rows), are equal in magnitude-but opposite in sign.

12. The method of claim 11 in which:

the first set of digital information signals are converted to analog information signals by: generating an analog ramp signal which begins at a zero or a low absolute voltage value and ramps up to a maximum absolute voltage value; successively comparing the digital information signals to the analog ramp signal; and selecting analog information signal values which correspond to the digital information signals; and the second set of digital information signals are converted to analog information signals by: generating an analog ramp signal which begins at a maximum absolute voltage value and ramps down to zero or a low absolute voltage value; successively comparing the digital information signals to the analog ramp signal; and selecting analog information signal values which corresponds to the digital information signals.

13. The method of claim 10 in which the first and second sets of converted analog signals are applied to the array during alternate frame periods, so that sampling errors in alternate frames are equal in magnitude but opposite in sign.

14. The method of claim 13 in which:

the first set of digital information signals are converted to analog information signals by: generating an analog ramp signal which begins at a zero or a low absolute voltage value and ramps up to a maximum absolute voltage value; successively comparing the digital information signals to the analog ramp signal; and selecting analog information signal values which correspond to the digital information signals; and the second set of digital information signals are converted to analog information signals by: generating an analog ramp signal which begins at a maximum absolute voltage value and ramps down to a zero or a low absolute voltage value; successively comparing the digital information signals to the analog ramp signal; and selecting analog information signal values which corresponds to the digital information signals.

15. A driver circuit for driving an electro-optic display device comprised of a row-and-column matrix array of pixels, comprising:

a digital-to-analog converter for converting a first set of digital information signals into a first set of analog information signals having sampling errors that result from the digital-to-analog conversion of the information signals, and for converting a second set of digital information signals into a second set of analog information signals having sampling errors equal in magnitude and opposite in sign to the sampling errors of the first set of signals, also as a result of the digital-to-analog conversion of the information signals, and means for applying the first and second sets of analog information signals to alternate columns/rows of the array, or to alternate sets of columns or sets of rows during each frame period, so that sampling errors in adjacent columns/rows, or adjacent sets of columns or sets of rows, are equal in magnitude but opposite in sign whereby the sampling errors effectively cancel one another.

16. The driver circuit as claimed in claim 15 wherein the electro-optic display device comprises a liquid crystal display device.

17. The driver circuit as claimed in claim 15 wherein the first set of analog information signals are applied to the odd numbered columns of the matrix array and the second set of analog information signals are applied to the even numbered columns of the matrix array.

* * * * *